US007383005B2

(12) United States Patent
Moteki

(10) Patent No.: US 7,383,005 B2
(45) Date of Patent: Jun. 3, 2008

(54) IMAGE FORMING APPARATUS WITH CURVED CONVEYANCE PATH BETWEEN FIRST AND SECOND TRANSFER PORTIONS

(75) Inventor: Junichi Moteki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 222 days.

(21) Appl. No.: 11/275,793

(22) Filed: Jan. 30, 2006

(65) Prior Publication Data

US 2006/0170713 A1 Aug. 3, 2006

(30) Foreign Application Priority Data

Feb. 2, 2005 (JP) ..... 2005-026352

(51) Int. Cl.
*G03G 15/16* (2006.01)
*G03G 15/00* (2006.01)

(52) U.S. Cl. ..... 399/309; 399/401

(58) Field of Classification Search ..... 399/309, 399/401, 308, 302

See application file for complete search history.

(56) References Cited

U.S. PATENT DOCUMENTS 5,519,484 A * 5/1996 Kumagai ..... 399/309
6,337,967 B1 * 1/2002 Izumi et al. ..... 399/302
6,626,103 B2 9/2003 Neumann ..... 101/230
7,245,844 B2 * 7/2007 de Jong et al.
2003/0066445 A1 4/2003 Neumann ..... 101/230
2005/0129442 A1 6/2005 Matsumoto et al. ..... 399/405

FOREIGN PATENT DOCUMENTS

JP 2000010370 A * 1/2000
JP 2000010371 A * 1/2000
JP 2001-175037 6/2001
JP 2002-20000 1/2002

* cited by examiner

*Primary Examiner*—Susan S. Lee
(74) *Attorney, Agent, or Firm*—Fitzpatrick, Cella, Harper & Scinto

(57) ABSTRACT

There is provided an image forming apparatus capable of image forming on both surfaces of a sheet, having a first transfer portion which transfers an image formed at an image forming unit to a first surface of the sheet, and a second transfer portion which transfers an image formed at the image forming unit to a second surface of the sheet, wherein the sheet on the first surface of which the image is formed at the first transfer portion is conveyed to the second transfer portion while keeping a front of the image to a front in a conveying direction, and the sheet is conveyed while keeping an end portion in a width direction of the sheet conveyed through the first transfer portion and the end portion in the width direction of the sheet conveyed through the second transfer portion on same end portion side relative to the sheet conveying direction.

10 Claims, 5 Drawing Sheets

IMAGE FORMING APPARATUS WITH CURVED CONVEYANCE PATH BETWEEN FIRST AND SECOND TRANSFER PORTIONS

BACKGROUND OF THE INVENTION

1. Field of the Invention

The present invention relates to an image forming apparatus such as a copying machine and a printer, and specifically relates to the image forming apparatus having two-sided recording function for forming images on both surfaces of a sheet.

2. Description of the Related Art

In order to record on both surfaces of a sheet in an image forming apparatus of an electrophotographic type such as a copying machine and a printer, the conventional apparatus has the structure to be described below.

The conventional apparatus is provided with a two-sided conveying mechanism of a switch back type. The mechanism conveys the sheet to a transfer portion, where, the sheet abuts an image bearing member, after forming a toner image on the image bearing member, and the toner image is electrically transferred to the sheet, thereby transferring the toner image to a first surface of the sheet, and the mechanism conveys the sheet to a fixing unit to fix the image on the first surface. After that, the mechanism reverses the sheet by switch back, and conveys the same to a two-sided conveyance path, such that the toner image is transferred to a second surface of the sheet.

Meanwhile, in a case in which the images are recorded on both surfaces of the sheet, it is required to record transfer images of the first and second surfaces without positional misalignment relative to the sheet.

And there is the two-sided conveying mechanism, in which positional misalignment is corrected in the two-sided conveyance path, through which the sheet is conveyed to be transferred the toner image to the second surface thereof after fixation of the toner image to the first surface thereof. This is to correct the skew feeding when the sheet is conveyed with declination relative to the conveying direction, and to prevent positional misalignment in a sheet width direction, which is orthogonal to the sheet conveying direction. For example, a mechanism, in which an end portion of one side of the sheet is struck to a abutment member, being a horizontal registration reference by a sheet shifting unit, as a position aligning unit in the sheet width direction, is suggested as disclosed in Japanese Patent Application Laid-Open No. 2001-175037.

However, in the above-described two-sided conveying mechanism of the switch back type, front and rear of the sheet relative to the conveying direction switches. Therefore, the tip end of the sheet when entering into the transfer portion when transferring to the first surface and the tip end of the sheet when entering into the transfer portion when transferring to the second surface are tip ends of different sides. So, if a length of the sheet in the conveying direction is different, misalignment in the conveying direction might be generated between the image position of the first surface and that of the second surface, when transferring the toner image on the transfer belt at a predetermined timing, by detecting the tip end of the sheet. And, if there is a positional misalignment between the image of the first surface and that of the second surface, there is a problem that a length of a margin on an upper portion of the sheet, on which the image is formed, is different between the first and second surfaces, so that it is not well-looking.

Therefore, there is the two-sided conveying mechanism disclosed in Japanese Patent Application Laid-Open No. 2002-020000. This is the two-sided conveying mechanism of a twist reversal type, in which the sheet is reversed by 180° in the sheet width direction so as to reverse only two surfaces of the sheet, and front/rear of the sheet relative to the conveying direction is not reversed, in order to improve a positional accuracy of the tip end of the image of the first surface and the tip end of the image of the second surface. In this mechanism, since the front and rear of the sheet is not switched by reversing the sheet, the positional alignment of the tip end of an image region on an upper portion of the first and second surfaces of the sheet may be performed with high accuracy.

However, the above-described conventional example has a problem as follows.

In the image forming apparatus having the two-sided conveying mechanism of the twist reversal type, the mechanism reverses the sheet by 180° in the sheet width direction while conveying the same, so that a large space is required in the sheet conveying direction and in the direction orthogonal to the sheet conveying direction. Especially, the larger the size of the sheet capable of image forming is, the larger the required space is. Therefore, a width and a height of the image forming apparatus main body become larger, so that the image forming apparatus itself becomes larger.

SUMMARY OF THE INVENTION

The present invention is made in view of the above-described problem. An object of the present invention is to provide an image forming apparatus in which a positional misalignment of an image is not occurred relative to a tip end of a sheet when performing a two-sided recording.

And another object of the present invention is to provide the image forming apparatus capable of performing the two-sided recording to the sheet while preventing the apparatus from being larger.

In order to solve the above-described problem, an image forming apparatus capable of image forming on both surfaces of a sheet has one image forming unit having two transfer portions, a first transfer portion which transfers an image to a first surface of the sheet, and a second transfer portion which transfers an image to a second surface of the sheet on the first surface of which the image is transferred at the first transfer portion, and a conveyance path which conveys the sheet from the first transfer portion to the second transfer portion, wherein said conveyance path is disposed such that the sheet is conveyed while keeping a front of the sheet transferred image at said first transfer portion in a conveying direction to a front of the sheet transferred image at said second transfer portion in the conveying direction on same portion, and that the sheet is conveyed while keeping an end portion in a width direction of the sheet transferred image at said first transfer portion and an end portion in a width direction of the sheet transferred image at said second transfer portion on same end portion side relative to a sheet conveying direction.

DESCRIPTION OF THE PREFERRED EMBODIMENT

Figure 1:
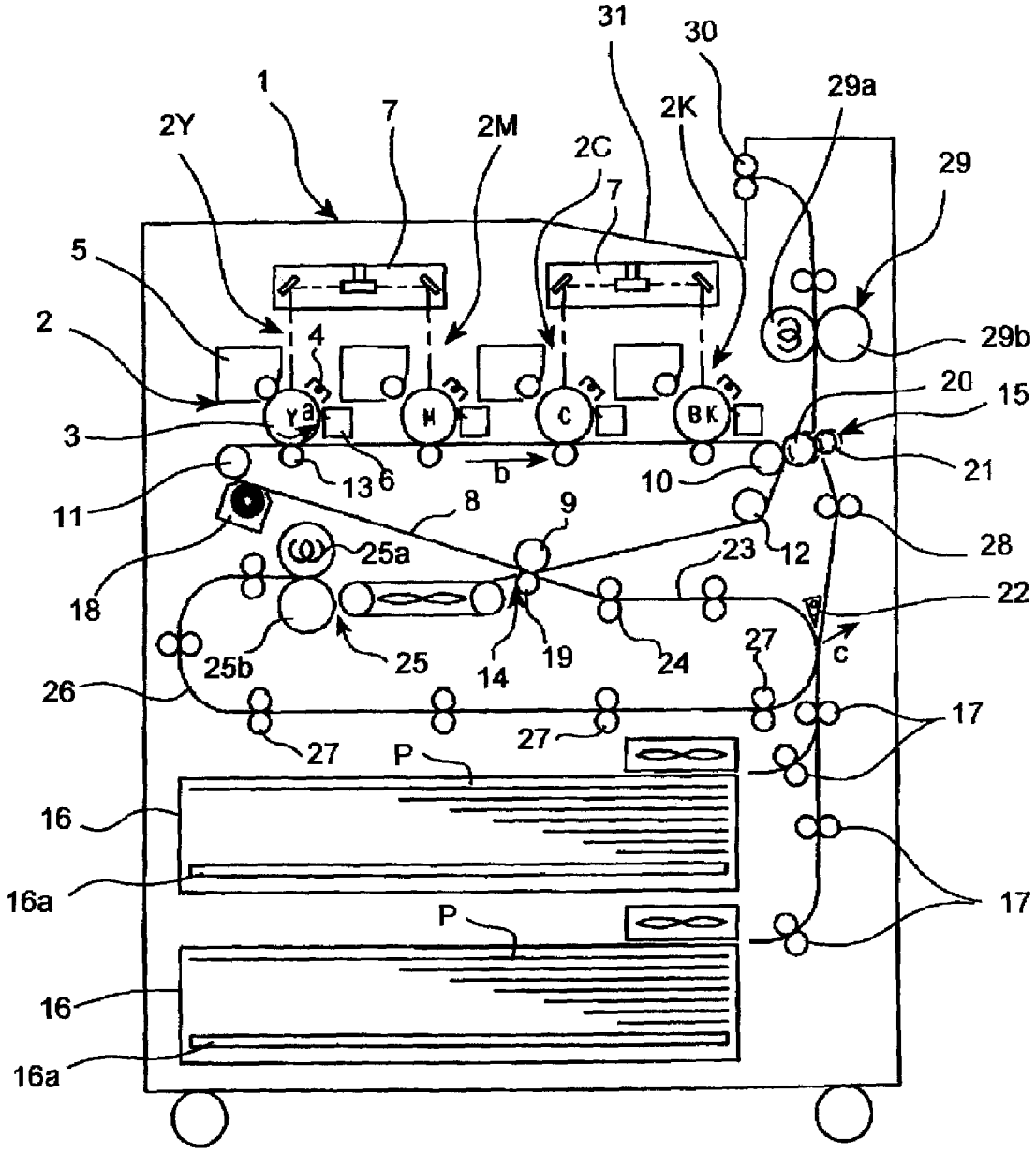
FIG. 1 is a schematic block diagram of an image forming apparatus according to a first embodiment of the present invention.

Next, an image forming apparatus according to an embodiment of the present invention will be specifically described with reference to the drawing.

First Embodiment

FIG. 1 is a schematic block diagram of an image forming apparatus according to a first embodiment of the present invention.

{Entire Structure of Image Forming Apparatus}

First, an entire structure of the image forming apparatus will be described. An image forming unit 2 is disposed on an upper portion of an apparatus main body 1. The image forming unit 2 is configured to upwardly convey a sheet from a feeding deck disposed on a lower portion of the apparatus main body and transfer an image formed by the image forming unit at a transfer portion to the same, then discharge the same to a discharge portion formed on an upper surface of the apparatus.

The image forming unit 2 is provided with four image forming stations substantially horizontally disposed, and in this embodiment, an yellow station 2Y, a magenta station 2M, a cyan station 2C, and a black station 2K are disposed from left to right of FIG. 1. Each of the stations is configured to form the image by each color toner in an electrophotographic type, and has identical structure except for different toner colors. Herein, the yellow station 2Y is illustrated by an example to briefly describe a structure thereof.

A primary charger 4, a development device 5, and a cleaning device 6 are disposed on a periphery of each of a photosensitive drum 3, which is an image bearing member. And, scanner units 7 which irradiate with a laser light according to an image signal are disposed on an upper portion of the photosensitive drums 3.

And an endless intermediate transfer belt 8 as an intermediate transfer member is rotatably supported by rollers 9, 10, 11 and 12 so as to abut the photosensitive drums 3, and a primary transfer roller 13 is disposed on a position opposed to the photosensitive drum 3 across the intermediate transfer belt 8.

When forming the image, a surface of the photosensitive drum 3 rotating in a direction indicated by an arrow a is uniformly charged by the primary charger 4, an electrostatic latent image is formed by the laser light irradiated from the scanner unit 7 according to the image signal, and the electrostatic latent image is toner developed by a development device 5 to be visualized.

The toner image is primary-transferred to the intermediate transfer belt 8 by applying bias to the primary transfer roller 13. And, a color image is formed by overlap-transferring each toner image of yellow, magenta, cyan and black, formed by each image forming station, to the intermediate transfer belt 8. First and second transfer portions 14 and 15 are disposed on predetermined positions of a rotation path of the intermediate transfer belt 8, and the toner image is secondary-transferred to a sheet conveyed by a sheet conveying unit to be recorded. Meanwhile, the first and second transfer portions 14 and 15 are provided for one image forming unit, and they are disposed in the order of the second transfer portion 15 and the first transfer portion 14 from an upstream side relative to a rotational direction of the intermediate transfer belt 8 indicated by an arrow b. Toner remained on the intermediate transfer belt 8 after transferring the toner image to the sheet is cleaned by a cleaning device 18.

A first fixing unit 25 is disposed on a downstream side of the first transfer portion 14 in a sheet conveying direction (hereinafter, simply referred to as "downstream side"). The first fixing unit 25 is provided with a heat roller 25*a* and a pressure roller 25*b* to apply heat and pressure to the sheet, on which the toner image is transferred at the first transfer portion 14. And, a second fixing unit 29 is disposed on a downstream side of the second transfer portion 15, and the second fixing unit 29 is provided with a heat roller 29*a* and a pressure roller 29*b* to apply heat and pressure to the sheet, on which the toner image is transferred at the second transfer portion 29.

A sheet P, which is stacked on a feeding deck 16 removably mounted on the lower portion of the apparatus main body, is separately fed one by one by a conveyance belt and a suction fan (not shown). The sheet P, which is separately fed, is upwardly conveyed by a conveyance roller pair 17, and the toner image is transferred at the transfer portion to form the image.

Meanwhile, by detecting a sheet surface height by a sheet surface detecting sensor (not shown) in the feeding deck 16, a lifter plate 16*a* is sequentially moved up and down to control a sheet surface position so as to prevent a miss-feed and a double-feed. And the sheet stacked on the lifter plate 16*a* is further inhibited to be double-fed by air applied for separating the sheets in a conveying direction and a direction orthogonal to the conveying direction (direction from front to back of the sheet).

{Two-sided Recording}

Next, a case in which the image is formed on both surfaces of the sheet by the above-described image forming apparatus will be described focusing on a flow of the sheet.

Herein, the apparatus is provided with two transfer portions for transferring the toner image to the sheet. The first transfer portion 14 for transferring the image to a first surface of the sheet when performing a two-sided recording is provided with a first inner roller 9 and a first outer roller 19 with the intermediate transfer belt 8 interposed therebetween. And, by sending a transfer current from the first inner roller 9 to the first outer roller 19, the toner image, which is primary-transferred to the intermediate transfer belt 8, is secondary-transferred to the sheet conveyed between the intermediate transfer belt 8 and the first outer roller 19.

And, the second transfer portion 15 for transferring the image to a second surface of the sheet is provided with a second inner roller 10 and an intermediate transfer roller 20 with the intermediate transfer belt 8 interposed therebetween, and the second outer roller 21 is provided so as to abut the intermediate transfer roller 20. And, the transfer portion 15 sends the transfer current from the second inner roller 10 to the intermediate transfer roller 20, further from the intermediate transfer roller 20 to the second outer roller 21, thereby transferring the toner image on the intermediate transfer belt 8 to the intermediate transfer roller 20. Further, the transfer portion 15 transfers the toner image to the sheet conveyed between the intermediate transfer roller 20 and the second outer roller 21. Meanwhile, the intermediate transfer roller 20 and the second outer roller 21 are detachably engaged relative to the intermediate transfer belt 8 by a separating unit such as a solenoid so as to be integrally structured.

When performing the two-sided recording, the intermediate transfer roller 20 and the second outer roller 21 are first separated from the intermediate transfer belt 8 by the separating unit (indicated by a broken line in FIG. 1). Then, the toner image of the first surface is formed by the four image forming stations, and the image of the first surface is transferred to the intermediate transfer belt 8 by applying bias to the primary transfer roller 13. The intermediate transfer belt 8 rotates in the direction indicated by the arrow b to deliver the image on the intermediate transfer belt 8 to the first transfer portion 14.

At this time, a conveyance path-switching flapper 22 is switched to a direction indicated by an arrow c to deliver the sheet P fed from the feeding deck 16 to a conveyance path 23. After that, the skew feeding of the sheet is corrected by a registration roller pair 24 and the sheet is conveyed in a substantially horizontal direction at a predetermined timing to be delivered to the first transfer portion, and the image of the first surface is transferred to a front surface of the sheet P.

The sheet, on the first surface of which the toner image is transferred, is guided to the first fixing unit 25 disposed on a downstream of the first transfer portion 14, and the toner image is melt and fixed to the sheet by heat and pressure applied to the same when this passes through a nip portion formed by the heat roller 25*a* and the pressure roller 25*b*.

The sheet passed through the fixing unit 25 is reversely delivered downward to a reverse path 26, which is a circularly formed conveyance path. And the sheet is upwardly delivered to a registration roller pair 28 disposed on an upstream side in the sheet conveying direction of the second transfer portion 15 (hereinafter, simply referred to as "upstream") through a refeed roller pair 27 at a predetermined timing.

And, after transferring the image of the first surface to the sheet by the first transfer portion 14 as described above, the intermediate transfer roller 20 and the second outer roller 21 of the second transfer portion 15 are integrally moved by the separating unit (not shown) such as a solenoid. Thereby the intermediate transfer roller 20 abuts the intermediate transfer belt 8 (position indicated by a solid line in FIG. 1)

After that, the image of the second surface is formed at the image forming unit 2, and the image is moved to the second transfer portion 15 by the rotation of the intermediate transfer belt 8 in the direction indicated by the arrow b. In synchronization with this, the skew feeding of the sheet is corrected by the registration roller pair 28 and the sheet is delivered to the second transfer portion 15 at a predetermined timing, and the image of the second surface is transferred to a rear surface of the sheet. Since the toner image on the intermediate transfer belt 8 is transferred to the sheet through the intermediate transfer roller 20 at the second transfer portion 15, the toner image can be transferred on the sheet by the rotation of the intermediate transfer belt 8 in the same direction as that in the image transfer of the first surface.

Then, the sheet, on which the toner image is transferred at the second transfer portion, is guided to the second fixing unit 29 disposed on the downstream side of the second transfer portion 15. The toner image is melt fixed to the sheet by heat and pressure applied to the same, when this passes through the nip portion formed by the heat roller 29*a* and the pressure roller 29*b* of the fixing unit 29. After a fixing process, the sheet is discharged to a discharge portion 31 provided on the upper portion of the image forming apparatus main body by means of a discharge roller pair 30.

As described above, it is structured such that the two transfer portions are disposed on a sheet conveyance path, and sheet, on which the image of the first surface is recorded at the first transfer portion 14, is conveyed to the second transfer portion 15, while keeping a front of the image to a front of the conveying direction. Thereby, a positional accuracy of a tip end of the image of the first surface and a tip end of the image of the second surface is improved. That is to say, the images can be formed to the front and rear surfaces of the sheet without reversing the sheet by switchback and turning.

And, it is structured such that an end portion in a width direction of the sheet conveyed in the first transfer portion 14 and an end portion in a width direction of the sheet conveyed in the second transfer portion 15 are on the same end portion side relative to the sheet conveying direction. Thereby, a positional accuracy of an end portion in a width direction of the image of the first surface and an end portion in a width direction of the image of the second surface is improved by guiding one end portion side based on one side in the sheet width direction. And, since the sheet width direction of the sheet conveyed from the first transfer portion 14 to the second transfer portion 15 is not reversed by 180° relative to the sheet conveying direction, a space to reverse the sheet by 180° is not required, thereby enabling a smaller image forming apparatus.

And, after transferring the toner images to both surfaces, they are fixed by respective fixing units 25 and 29, so that thermal storage in the fixing units is made smaller, thereby enabling an easier thermal control thereof.

{Single-sided Recording}

Next, a case in which the image is formed on one surface of the sheet will be described. When performing a single-sided recording, a flapper 22 switches to a direction opposed to the direction indicated by an arrow c, and the sheet, which is separately fed from the feeding deck 16 is delivered to the registration roller pair 28, where the skew feeding thereof is corrected, and is conveyed to the second transfer portion 15 at a predetermined timing. On the other hand, the image is formed at the image forming unit 2 in synchronization with the sheet convey, and the image is moved to the second transfer portion 15 by the rotation of the intermediate transfer belt 8 in the direction indicated by the arrow b to transfer-record the image to one surface of the conveyed sheet.

The sheet, on which the image is recorded, is conveyed to the second fixing unit 29 where the toner image is fixed, and is discharged to the discharge portion 31 disposed on the upper portion of the apparatus by means of the discharge roller pair 30.

In this manner, the sheet is conveyed from the lower portion of the apparatus to the upper portion thereof in a substantially linearly when performing the single-sided recording, so that the sheet conveyance path from the feeding deck 16 to the discharge portion 31 becomes shorter. Therefore, elapsed time from feeding of the sheet to discharging thereof becomes shorter, thereby improving productivity.

Meanwhile, when performing the single-sided recording, the image may be transferred on one surface of the sheet by using the first transfer portion 14 and fixed by means of the first fixing unit 25. In this case, in the second transfer portion 15, the intermediate transfer roller 20 and the second outer roller 21 are separated from the intermediate transfer belt 8 to serve only to convey the sheet. And, the second fixing unit 29 may apply heat and pressure to the conveyed sheet. This is to obtain a high image quality, because it is known that the toner is better fixed, thereby improving the image quality after being fixed twice.

Second Embodiment

Figure 2:
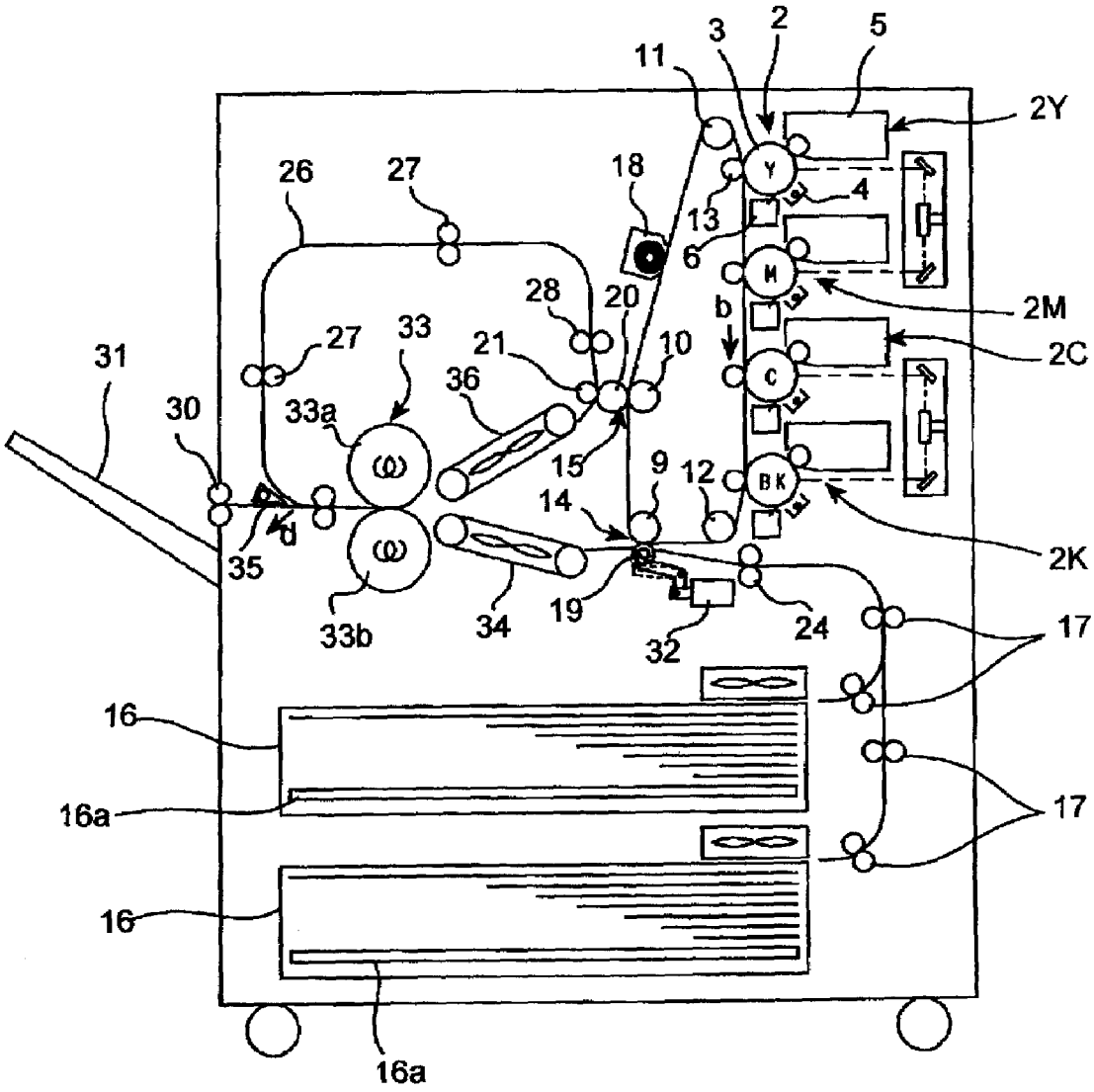
FIG. 2 is a schematic block diagram of an image forming apparatus according to a second embodiment of the present invention.

Next, the apparatus according to a second embodiment will be described with reference to FIG. 2. Meanwhile, a basic structure of the apparatus of this embodiment is similar to that of the above-described first embodiment, so that a structure different from that of the first embodiment will be described in detail, while omitting an overlapping description. And, the same reference numeral is designated as a member having same function as that of the above-described embodiment.

The image forming apparatus of this embodiment is provided with the image forming unit 2, in which the four photosensitive drums 3 are vertically disposed. And, this embodiment is similar to the first embodiment in having the first transfer portion 14, which transfers the image formed by the one image forming unit 2 to the first surface of the sheet and the second transfer portion 15, which transfers the image to the second surface of the sheet. However, this embodiment is different from the first embodiment in that the first outer roller 19 forming the first transfer portion 14 is detachably engaged to the intermediate transfer belt 8 by means of the separating unit such as a solenoid 32. Meanwhile, it is disposed in the order of the first transfer portion 14 and the second transfer portion 15 from the upstream side relative to the rotating direction of the intermediate transfer belt indicated by the arrow b, and the circular conveyance path is provided between the first transfer portion 14 and the second transfer portion 15.

And, a fixing unit 33 is provided on a crossover portion of the circular conveyance path on a downstream side of the first transfer portion 14, the fixing unit 33 is composed of two heat rollers 33*a* and 33*b* to heat both of the front and rear surfaces of the conveyed sheet.

{Single-sided Recording}

In the image forming apparatus of this embodiment, when the image is recorded on one surface of the sheet, the sheet separately fed from the feeding deck 16 is delivered to the registration roller pair 24, and the skew feeding thereof is corrected and conveyed to the first transfer portion 14 at a predetermined timing. On the other hand, the image is formed at the image forming unit 2 in synchronization with the sheet conveyance, and the image is moved to the first transfer portion 14 by the rotation of the intermediate transfer belt 8 in the direction indicated by the arrow b, thereby the image is transfer-recorded to one surface of the conveyed sheet.

The sheet, on which the image is recorded, is conveyed to the fixing unit 33 while being inhibited to be floated by means of a suction conveying unit 34, in which the sheet is absorbed by the sucking fun and conveyed by the conveyance belt, and the toner image is fixed, then the sheet is discharged to the discharge portion 31 disposed on the upper portion of the apparatus by means of the discharge roller pair 30.

{Two-sided Recording}

Next, the case of performing a two-sided recording will be described. The recording on the first surface is performed in the same way as in the case of the single-sided recording. Then, after the image is recorded and fixed to the first surface of the sheet, a switching flapper 35 rotates in the direction indicated by an arrow d and the sheet is delivered to the reverse path 26. Further, the sheet is delivered to the registration roller pair 28 disposed on the upstream side of the second transfer portion 15, where the skew feeding thereof is corrected by means of the refeed roller pair 27, at a predetermined timing. And, after transferring the image of the first surface to the sheet at the first transfer portion 14, the solenoid 32 drives to separate the first outer roller 19 from the intermediate transfer belt 8.

On the other hand, at the image forming unit 2, the image of the second surface is formed in synchronization with the sheet conveyance, and the image of the second surface is transferred to the intermediate transfer belt 8 by applying bias to the transfer roller 13.

Then the sheet, on which the toner image is transferred at the second transfer portion, is conveyed again to the fixing unit 33 while being absorbed by a suction conveying unit 36, in which the sheet is absorbed to the conveyance belt by the suction fan and conveyed, and the toner image of the second surface is fixed. Further, the switching flapper 35 switches to a direction opposite to the direction indicated by the arrow d, and the sheet, to which the toner image is fixed is discharged to the discharge portion 31 disposed on the upper portion of the apparatus by means of the discharge roller pair 30.

In above-structured embodiment also, the sheet, on which the image of the first surface is recorded, is conveyed to the second transfer portion 15, while keeping the front of the image to the front of the conveying direction, as in the first embodiment. Further, the sheet is conveyed such that the end portion in the width direction of the sheet conveyed in the first transfer portion 14 and the end portion in the width direction of the sheet conveyed in the second transfer portion 15 are on the same end portion side relative to the sheet conveying direction. Therefore, the positional accuracy of the tip end of the image of the first surface and the tip end of the image of the second surface, and the positional accuracy in the width direction are improved.

Further, since the fixing unit 33 for fixing the images of the first and second surfaces is common in this embodiment, the number of the fixing units is reduced, thereby enabling a smaller apparatus and a lower cost thereof.

Third Embodiment

Figure 3:
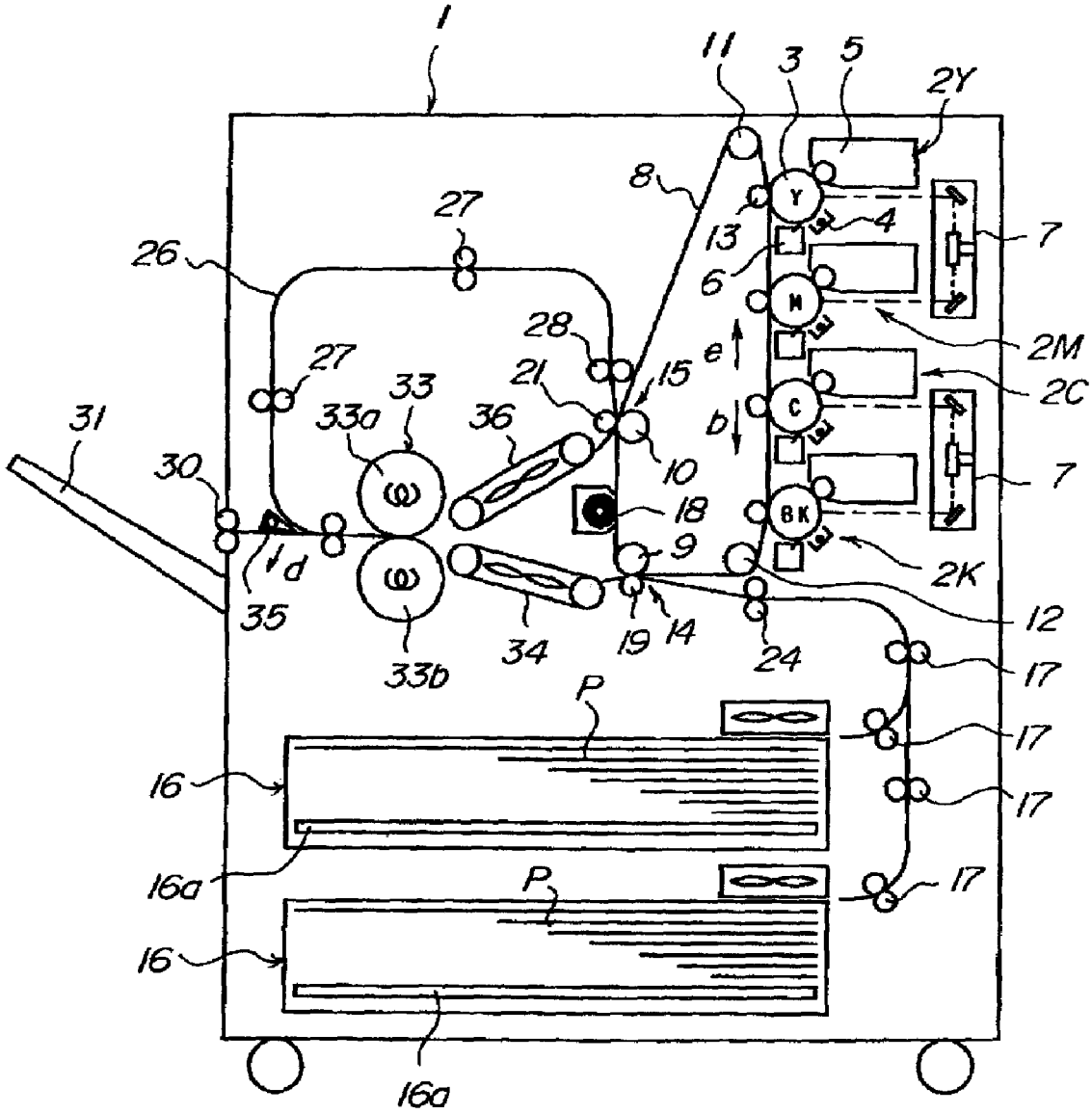
FIG. 3 is a schematic block diagram of an image forming apparatus according to a third embodiment of the present invention.

Next, the apparatus according to a third embodiment will be described with reference to FIG. 3. Meanwhile, a basic structure of the apparatus of this embodiment is similar to that of the above-described second embodiment, so that a structure different from that of the second embodiment will be described in detail, while not showing an overlapping description. And, the same reference numeral is designated as a member having same function as that of the above-described embodiment.

In the above-described embodiment, the second transfer portion 15 is structured such that the toner image on the intermediate transfer belt 8 is transferred to the sheet through the intermediate transfer roller 20. In this embodiment, it is structured such that the toner image on the intermediate transfer belt 8 is directly transferred to the sheet without providing the intermediate transfer roller.

And, the separating unit for separating the first outer roller 19 of the first transfer portion 14 from the intermediate transfer belt 8 is not provided. Further, the cleaning device 18 for cleaning the intermediate transfer belt 8 is disposed between the first transfer portion 14 and the second transfer portion 15.

In the image forming apparatus of this embodiment, the single-sided recording to the sheet is performed in the same way as in the above-described first embodiment.

When performing the two-sided recording, the sheet, on the first surface of which the image is formed at the first transfer portion 14 in the same way as in the single-sided recording, is delivered to the reverse path 26, and is delivered to the registration roller pair 28 disposed on the upstream side of the second transfer portion 15 by means of the refeed roller pair 27 at a predetermined timing, and the skew feeding thereof is corrected.

In the image forming unit 2, the image of the second surface is formed in synchronization with the sheet conveyance. Behavior of the image forming unit 2 is as follows: the intermediate transfer belt 8 is rotated in the direction indicated by the arrow b, as in the image forming of the fist surface, and each of the toner images of yellow, magenta, cyan and black is transferred to the intermediate transfer belt 8 in this order, thereby forming the color image. And, the intermediate transfer belt 8, on which the color image is formed, is rotated in the direction indicated by the arrow e, which is a direction opposed to the direction in forming the image to move the image to the second transfer portion 15. At this time, the photosensitive drums 3 are electrically charged with same polarity as the transferred toner (for example, positive polarity). That is to say, the photosensitive drums 3 are electrically charged with electric charge having the same polarity as that of the toner, so that the image of the second surface on the intermediate transfer belt 8 moves to the second transfer portion 15 without being returned to the photosensitive drums 3.

Then the image of the second surface is transferred to the conveyed sheet by rotating the intermediate transfer belt 8 in a direction indicated by an arrow e, and applying bias to the second outer roller 21. The sheet, on which the toner image is transferred, is conveyed to the fixing unit 33 in a state of being absorbed to the suction conveying unit 36, where the toner is fixed, thereby discharged to the discharge portion 31 by means of the discharge roller pair 30.

At this time, the intermediate transfer belt 8 is rotated in the direction indicated by the arrow b when performing the primary-transfer, and in the direction indicated by the arrow e when performing the secondary-transfer. This is to obtain a better image quality with the first and second surfaces having the same color, by overlapping each of the toner images of yellow, magenta, cyan and black by primary-transferring in the same order as in the image forming of the first surface when forming the image of the second surface.

As described above, in the image forming apparatus of this embodiment also, the sheet, on which the image of the first surface is recorded, is conveyed to the second transfer portion 15, while keeping the front of the image to the front of the conveying direction. Further, the sheet is conveyed such that the end portion in the width direction of the sheet conveyed in the first transfer portion 14 and the end portion in the width direction of the sheet conveyed in the second transfer portion 15 are on the same end portion side relative to the sheet conveying direction. Therefore, the positional accuracy of the tip ends and in the width direction of images of the first and second surfaces is improved.

FOURTH EMBODIMENT

Figure 4:
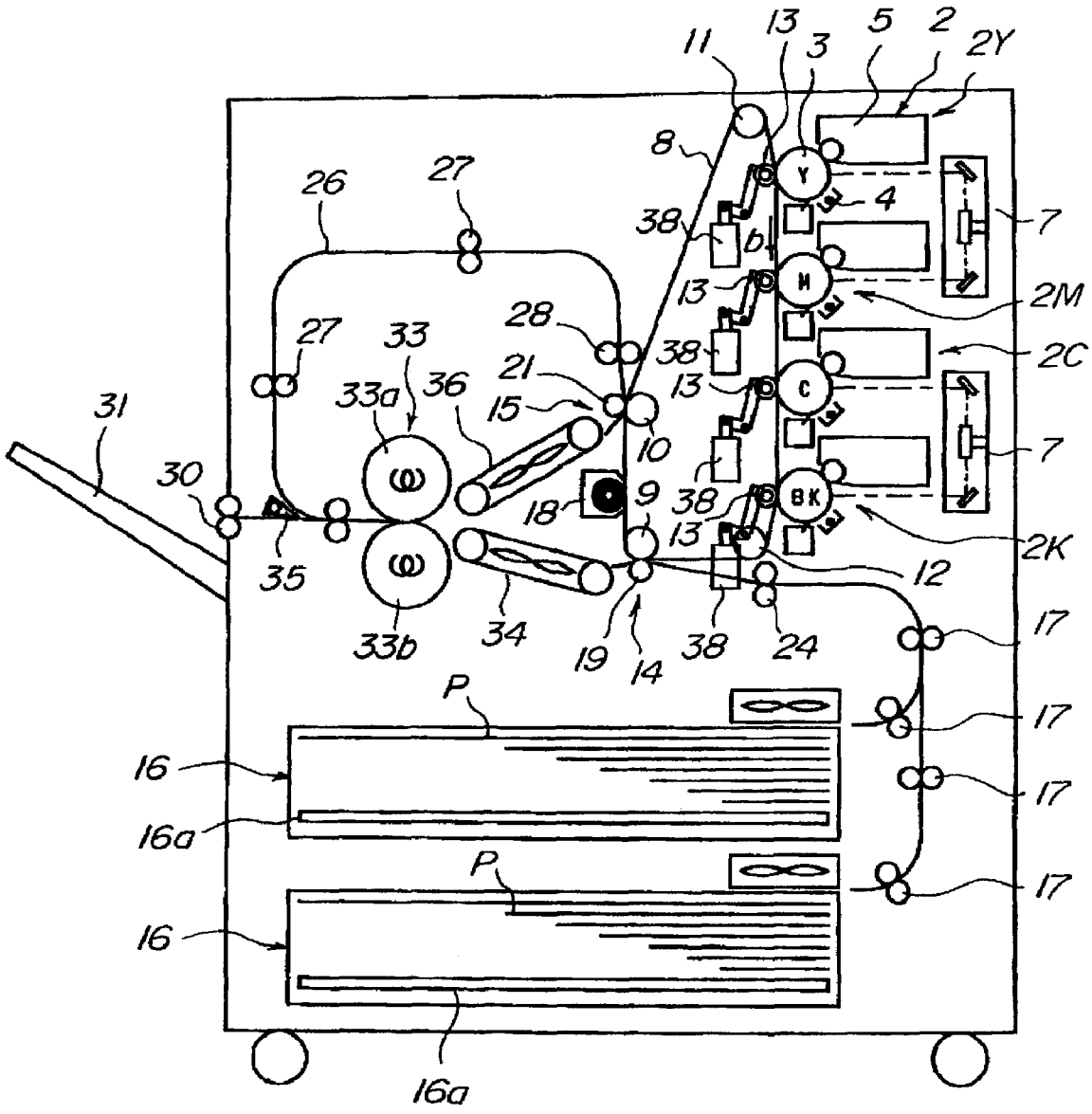
FIG. 4 is a schematic block diagram of an image forming apparatus according to a fourth embodiment of the present invention showing a state in image forming.

Next, the apparatus according to a fourth embodiment will be described with reference to FIGS. 4 and 5. Meanwhile, abasic structure of the apparatus of this embodiment is similar to that of the above-described third embodiment, so that a structure different from that of the third embodiment will be described in detail, while not showing an overlapping description. And, the same reference numeral is designated as a member having same function as that of the above-described embodiment.

In the above-described third embodiment, the photosensitive drums 3 are electrically charged with same polarity as the toner image so as to prevent the toner image on the intermediate transfer belt 8 from returning to the photosensitive drums 3 when the intermediate transfer belt 8 is rotated in the opposite direction after forming the image of the second surface. However, in this embodiment, the separating unit formed by a solenoid 37 or the like for making the primary transfer roller 13 abut and separate from the intermediate transfer belt 8 is provided. When the solenoid 37 is in off state, the primary transfer roller 13 biases the intermediate transfer belt 8 in a direction toward the photosensitive drums 3 as shown in FIG. 4, and the intermediate transfer belt 8 abuts the photosensitive drums 3. On the other hand, when the solenoid 37 is in on state, the primary transfer roller 13 is separated from the intermediate transfer belt 8 so that the intermediate transfer belt 8 is separated from the photosensitive drums 3 as shown in FIG. 5.

Figure 5:
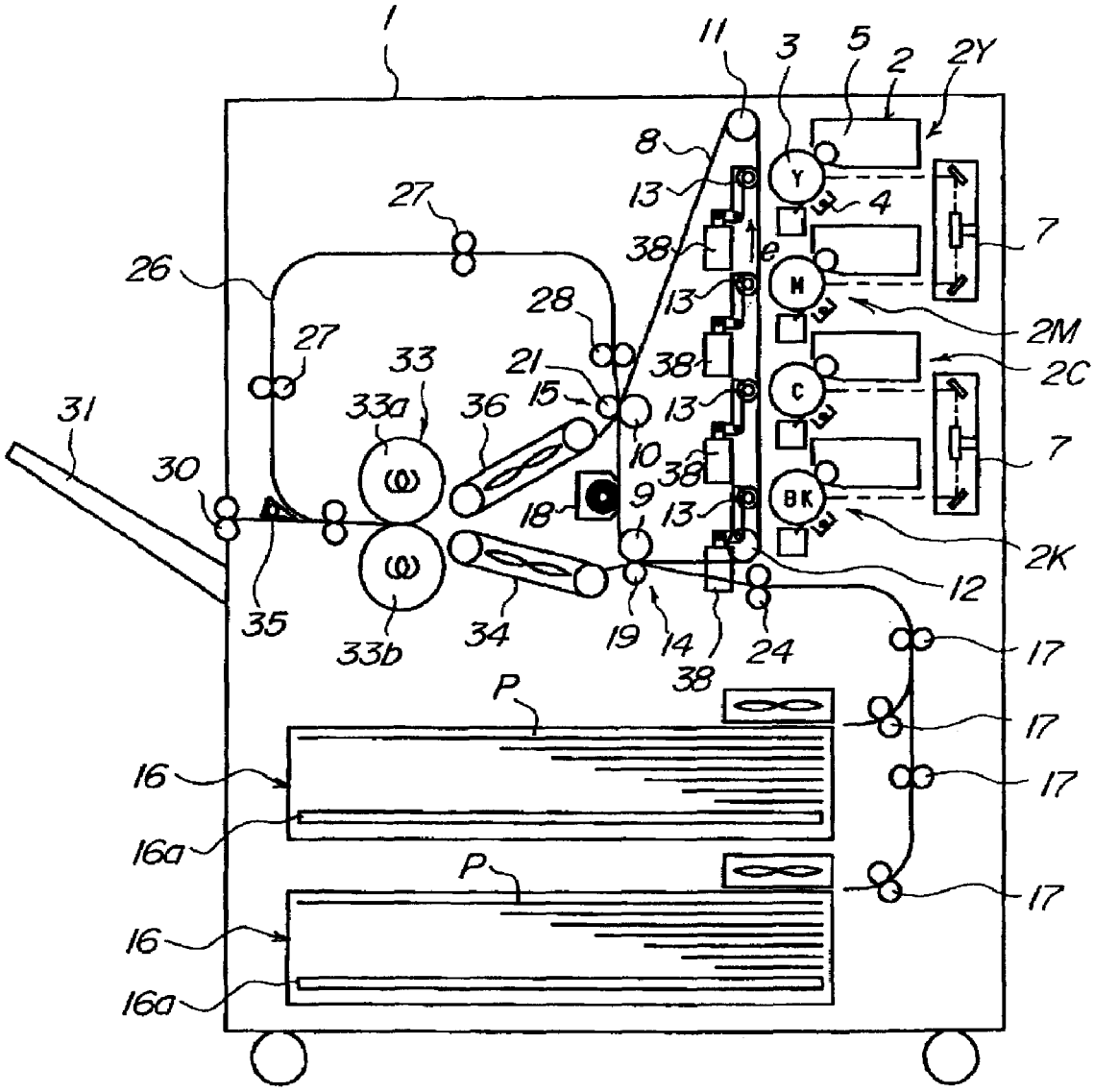
FIG. 5 is a schematic block diagram of an image forming apparatus according to a fourth embodiment of the present invention showing a state in which a toner image of a second surface is moved to a second transfer portion.

Therefore, when the intermediate transfer belt 8 is rotated in the opposite direction to move the toner image to the second transfer portion 15, after transferring the toner image of the second surface to the intermediate transfer belt 8, the intermediate transfer belt 8 and the photosensitive drums 3 are separated as shown in FIG. 5. Thereby, the image of the second surface on the intermediate transfer belt 8 is not returned to the photosensitive drums 3, even if the photosensitive drums 3 are not electrically charged with the same polarity as that of the toner, as in the third embodiment.

Although a method of transferring the toner image from the four image forming stations each having the photosensitive drum to the intermediate transfer belt is described as the image forming unit in this embodiment, the present invention is not to be limited to this. For example, the present invention may be applied to an image forming unit of a method in which the toner image is transferred from the four image forming stations to not the intermediate transfer belt but an intermediate transfer drum. And although the color image forming apparatus is described in this embodiment, the present invention may be applied to a black and white image forming apparatus.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of priority from the prior Japanese Patent Application No. 2005-026352 filed on Feb. 2, 2005 the entire contents of which are incorporated by reference herein.

What is claimed is:

1. An image forming apparatus capable of image forming on both surfaces of a sheet, comprising:

one image forming unit having two transfer portions, a first transfer portion which transfers an image to a first surface of the sheet, and a second transfer portion which transfers an image to a second surface of the sheet on the first surface of which the image is transferred at said first transfer portion; and a conveyance path which guides the sheet from said first transfer portion to said second transfer portion, wherein the conveyance path is circularly formed, wherein the sheet is guided by said conveyance path such that a front of the sheet transferred image at said first transfer portion in a conveying direction is a same portion as a front of the sheet transferred image at said second transfer portion, and the sheet is guided by said conveyance path such that an end portion in a width direction of the sheet transferred image at said first transfer portion is a same end portion relative to a sheet conveying direction as an end portion in the width direction of the sheet transferred image at said second transfer portion.

2. The image forming apparatus according to claim 1, wherein a first fixing unit which fixes a toner image transferred to the first surface of the sheet at said first transfer portion, is disposed downstream in a sheet conveying direction of said first transfer portion, and a second fixing unit which fixes the toner image transferred to the second surface of the sheet at said second transfer portion, is disposed downstream in the sheet conveying direction of said second transfer portion.

3. The image forming apparatus according to claim 1, wherein a fixing unit is disposed downstream of a cross-over portion of said circularly formed conveyance path to fix the toner image transferred to the first surface of the sheet at said first transfer portion, and then, to fix the toner image transferred to the second surface of the sheet at said second transfer portion.

4. The image forming apparatus according to claim 1, wherein said first transfer portion is disposed so as to transfer to the sheet conveyed in a horizontal direction, and said second transfer portion is disposed so as to transfer to the sheet conveyed in a vertical direction, and said circular conveyance path horizontally guides the sheet at said first transfer portion, then reverses the sheet downward, and further upwardly guides the sheet from a lower portion to said second transfer portion.

5. The image forming apparatus according to claim 4, wherein said conveyance path is extended so as to discharge the sheet to which the toner image is transferred at said second transfer portion, to a discharge portion disposed on an upper portion of the apparatus main body.

6. The image forming apparatus according to claim 1, wherein said image forming unit comprises four image forming stations each having an image bearing member, an intermediate transfer member, to which the toner images formed on each image bearing member of said image forming stations are transferred, and said first and second transfer portions disposed on different positions relative to said intermediate transfer member, and said intermediate transfer member is rotated to transfer the toner image of a first surface to the sheet at said first transfer portion and to transfer the toner image of a second surface to the sheet at said second transfer portion.

7. The image forming apparatus according to claim 6, wherein said first transfer portion is detachably engaged to said intermediate transfer member when said first transfer portion is disposed upstream relative to a rotating direction of said intermediate transfer member, and said second transfer portion is detachably engaged to said intermediate transfer member when said second transfer portion is disposed upstream.

8. The image forming apparatus according to claim 6, wherein said intermediate transfer member is rotated in a direction opposite to the direction in transferring the toner image to the sheet at said first transfer portion, when transferring the toner image at said second transfer portion.

9. The image forming apparatus according to claim 8, wherein said image bearing member is charged with same polarity as that of the toner image on said intermediate transfer member, when said intermediate transfer member is rotated in a direction opposite to the direction in transferring the toner image of the first surface, to transfer the toner image to the second surface.

10. The image forming apparatus according to claim 8, wherein said intermediate transfer member is disengaged from the image bearing member, when said intermediate transfer member is rotated in a direction opposite to the direction in transferring the toner image of the first surface, to transfer the toner image to the second surface.

* * * * *

UNITED STATES PATENT AND TRADEMARK OFFICE

CERTIFICATE OF CORRECTION

PATENT NO. : 7,383,005 B2
APPLICATION NO. : 11/275793
DATED : June 3, 2008
INVENTOR(S) : Moteki It is certified that error appears in the above-identified patent and that said Letters Patent is hereby corrected as shown below:

ON THE TITLE PAGE:
At Item (56), References Cited, Foreign Patent Documents, "2000010370 A" should read --2000-10370 A--, and "2000010371 A" should read --2000-10371 A--.

COLUMN 1:
Line 36, "to be" should read --so that--.
Line 37, "transferred the toner image" should read --the toner image is transferred--.
Line 44, "struck to" should read --struck against--, and "a" should read --an--.
Line 64, "that" should read --in that--.

COLUMN 2:
Line 10, "is" should read --are--.
Line 33, "is not occurred" should read --does not occur--.

COLUMN 3:
Line 36, "an" should read --a--.

COLUMN 4:
Line 11, "remained" should read --remaining--.
Line 38, "to be" should read --from being--.

COLUMN 5:
Line 67, "on" should read --to--.

COLUMN 6:
Line 16, "to" (second occurrence) should read --on--.
Line 49, "convey," should read --conveyance,--.
Line 62, "linearly" should read --linear path--.

COLUMN 7:
Line 2, "on" should read --to--.
Line 61, "to be floated" should read --from floating--.

UNITED STATES PATENT AND TRADEMARK OFFICE

CERTIFICATE OF CORRECTION

PATENT NO. : 7,383,005 B2
APPLICATION NO. : 11/275793
DATED : June 3, 2008
INVENTOR(S) : Moteki It is certified that error appears in the above-identified patent and that said Letters Patent is hereby corrected as shown below:

COLUMN 9:
Line 22, "fist" should read --first--.
Line 44, "discharged" should read --being discharged--.

COLUMN 10:
Line 5, "abasic" should read --a basic--.

Signed and Sealed this

Thirteenth Day of January, 2009

JON W. DUDAS
*Director of the United States Patent and Trademark Office*